US006138631A

United States Patent [19]

Stromsky et al.

[11] Patent Number: 6,138,631

[45] Date of Patent: Oct. 31, 2000

[54] CYLINDER HEAD FOR AN INTERNAL-COMBUSTION ENGINE

[75] Inventors: Roland Stromsky, Freiberg; Albrecht Reustle, Wahlheim, both of Germany

[73] Assignee: Dr. Ing. h.c.F. Porsche AG, Weissach, Germany

[21] Appl. No.: 09/344,246

[22] Filed: Jun. 25, 1999

[30] Foreign Application Priority Data

Jun. 25, 1998 [DE] Germany ..... 198 28 308

[51] Int. Cl.[7] ..... F02F 1/38

[52] U.S. Cl. ..... 123/193.5

[58] Field of Search ..... 123/193.5, 90.27, 123/41.82

[56] References Cited

U.S. PATENT DOCUMENTS

| | | | |
|---|---|---|---|
| 4,641,609 | 2/1987 | Tanaka | 123/193.5 |
| 4,658,763 | 4/1987 | Gobien et al. | 123/193.5 |
| 4,951,622 | 8/1990 | Takahashi . | |
| 5,408,958 | 4/1995 | Esch et al. | 123/90.27 |

FOREIGN PATENT DOCUMENTS

| | | |
|---|---|---|
| 0 635 631 | 1/1995 | European Pat. Off. . |
| 39 23 984 | 1/1990 | Germany . |
| 40 07 939 | 8/1991 | Germany . |

*Primary Examiner*—Marguerite McMahon
*Attorney, Agent, or Firm*—Evenson, McKeown, Edwards & Lenahan, P.L.L.C.

[57] ABSTRACT

A cylinder head with two overhead camshafts is divided by longitudinal and transverse walls into several subspaces in the area of its leakage-oil-carrying interior. Due to this partitioning of the leakage-oil-carrying interior, it is ensured that oil scavenging is as fast as possible and oil foaming is simultaneously minimized.

20 Claims, 4 Drawing Sheets

CYLINDER HEAD FOR AN INTERNAL-COMBUSTION ENGINE

BACKGROUND AND SUMMARY OF THE INVENTION

This application claims the priority of German patent 198 28 308.3, filed Jun. 25, 1998, the disclosure of which is expressly incorporated by reference herein.

This application is related to U.S. patent application Ser. No. 09/344,247, which is a counterpart of German patent application 198 28 307.5.

The invention relates to a cylinder head of an internal-combustion engine with a device for returning lubricating oil from the interior of the cylinder head.

From German Patent Document DE 27 37 901 A1, a cylinder head of this type is known, in which an overhead camshaft is disposed. The interior receiving the camshaft is divided in the longitudinal direction of the cylinder head by transverse walls into individual subspaces. These transverse walls simultaneously form the bearing of the camshaft. Each of these subspaces is connected by way of an opening with a collector constructed on the underside of the cylinder head housing.

Furthermore, from German Patent Document DE 40 07 939 C1, a cylinder head is known in which—without any explicit representation or description—two overhead camshafts are disposed. On the exterior side of the cylinder head, a separate collector is fastened which is connected with the interior by way of several bores arranged in the cylinder head and distributed along the longitudinal course. By way of these bores, the lubricating oil which collects in the interior of the cylinder head and flows out at the different bearing points, is guided into the collector which is connected by way of a pump and a return flow pipe with the oil storage tank of the internal-combustion engine. In the oil-carrying interior of the cylinder head, relatively large amounts of oil are carried which flow out at the bearing points of the camshafts and of the bucket tappets or valve levers. Such cylinder heads have the disadvantage that this oil can spread almost unhindered in the interior before it changes by way of the lateral ducts into the oil collector. Because of the longer dwell time of this oil in the interior, an increased foaming of the oil may occur. In this case, larger free oil quantities in the interior of the cylinder head as well as an increased foaming of the oil are critical with respect to the oil circulation of the internal-combustion engine.

It is therefore an object of the invention to improve a cylinder head of an internal-combustion engine with a device for returning lubricating oil from the interior in such a manner that the oil carried freely in the interior is foamed as little as possible and reaches the scavenging point over a short distance. Furthermore, the oil quantities situated freely in the interior of the cylinder head are to be minimized and a collection of larger oil quantities in the interior during accelerations/decelerations and/or cornering is to be avoided.

According to the invention, this and other objects have been achieved by providing a cylinder head of a multi-cylinder internal-combustion engine having two overhead camshafts, comprising: a cylinder head defining an interior space for receiving said camshafts, said cylinder head defining at least one collector which extends in a longitudinal direction of the cylinder head and which is connected with a suction connection of a pump, said interior space being divided into a plurality of subspaces by longitudinal walls located between the two camshafts and by at least one transverse wall, at least some of said subspaces being connected with a collector.

According to the invention, this and other objects have been achieved by providing a cylinder head, comprising a camshaft housing including: a pair of longitudinal exterior walls; a pair of end exterior walls extending between respective ends of said longitudinal exterior walls, said longitudinal exterior walls and said end exterior walls defining an interior space; at least one transverse wall extending between said longitudinal exterior walls through said interior space and defining first and second bearings for supporting first and second camshafts, respectively; at least one longitudinal wall extending between said end exterior walls through said interior space at a location between said first and second bearings of said at least one transverse wall, said at least one transverse wall and said at least one longitudinal wall dividing said interior space into a plurality of subspaces; and a longitudinally-extending oil collecting duct.

Due to the division of the cylinder head in the longitudinal and transverse direction, defined subspaces are formed which limit the expansion of the oil which is in each case carried freely in the subspaces. From these subspaces, the oil emerging at the bearing points can be guided along a short distance to the collector, in which case the dwell time of the oil in the interior of the cylinder head is clearly reduced. By limiting the free space and by rapidly feeding the oil to the collectors, it is ensured that the foaming of the oil remains slight.

Such a partitioning of the interior can take place in a particularly advantageous manner if the bearing sections for receiving the camshafts are constructed as transverse walls and extend continuously to the respective adjoining side walls. By the integration of the function of the camshaft bearing and the transverse wall for the partitioning of the interior, sufficient free space remains for housing the cams and the stroke transmission elements, such as the bucket tappets or valve levers.

If the partitioning of the interior aligned in the longitudinal direction of the cylinder head is constructed by two longitudinal walls, the space in-between can be used particularly advantageously as an oil-free space for receiving a spark plug or an injection system. By means of such a partitioning, not only the above-described advantages with respect to the guiding of oil are achieved but, in addition, a very stiff structure of the cylinder head is achieved.

A particularly fast oil scavenging from the cylinder head with paths which are as short as possible is permitted if the collector is arranged on the underside of the subspaces which are on the bottom in the installed position. It is also advantageous for the connections to the lower subspaces and to the upper subspaces disposed above to be arranged above one another.

A scavenging of the oil which is fast also in the case of fluctuating oil levels as the result of accelerations/decelerations and/or cornering is permitted if the subspaces are connected with the collector by way of two openings arranged on opposite walls. As a result, it is ensured that also in the event of considerably fluctuating oil levels within the subspaces, a short and fast connection to the collector is ensured at any time. If such a cylinder head is arranged, for example, in the longitudinal direction, these connections can advantageously be arranged at the respective forward and rearward end of the subspace so that the fluctuations of the oil level are taken into account mainly during an acceleration and deceleration.

Due to the arrangement of a second collector on the cylinder head, which collector is constructed separately from the first collector and of which one collector is connected in the forward or rearward area of the cylinder head with the interior, while the other collector is connected in the opposite rearward and forward area of the cylinder head with its interior, also the oil which collects in the event of high accelerations almost completely in an end area of the cylinder head can be scavenged because an oil level occurs at any time in at least one of the two collectors which—without taking in air—can be scavenged by the oil pump. Due to such a construction of the cylinder head, it is possible to reliably scavenge the oil accumulating in the interior despite fluctuations of the oil level because of accelerations or cornering without the requirement of movable components, such as valves, flap valves or similar structural components.

A particularly reliable oil scavenging is advantageously ensured when both collectors are connected with one another at their end facing away from the suction point. If, in the case of such a cylinder head, the oil situated in the cylinder head because of accelerations accumulates essentially in the area of this connection point, the oil situated in the first collector can also be scavenged by way of the connection of the two collectors.

The collectors can be constructed in a particularly advantageous manner and at reasonable cost if, in the case of cast components of the cylinder head, they are also cast in so that neither external pipes, screwed connections with corresponding tightness problems nor long bores with corresponding expenditures during the manufacturing are required.

It is also advantageous for the two collectors to be constructed in different components of the cylinder head, in which case a particularly simple connection of the two collectors can take place by way of a common flange surface.

Other objects, advantages and novel features of the present invention will become apparent from the following detailed description of the invention when considered in conjunction with the accompanying drawings.

DETAILED DESCRIPTION OF THE DRAWINGS

Figure 1:
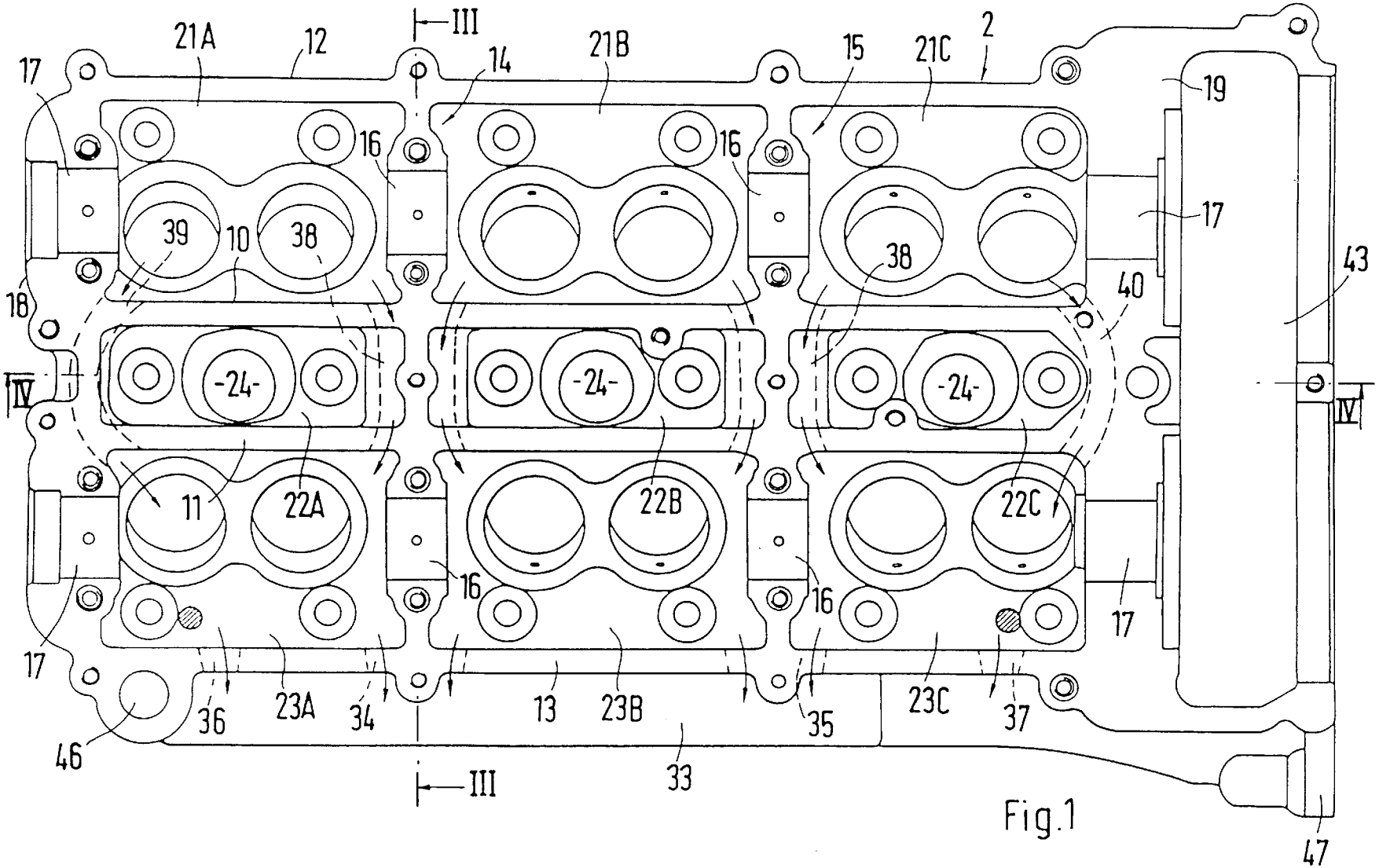
FIG. 1 is a top view of the flange surface of the camshaft housing facing the cylinder head cover according to a preferred embodiment of the present invention.
Figure 2:
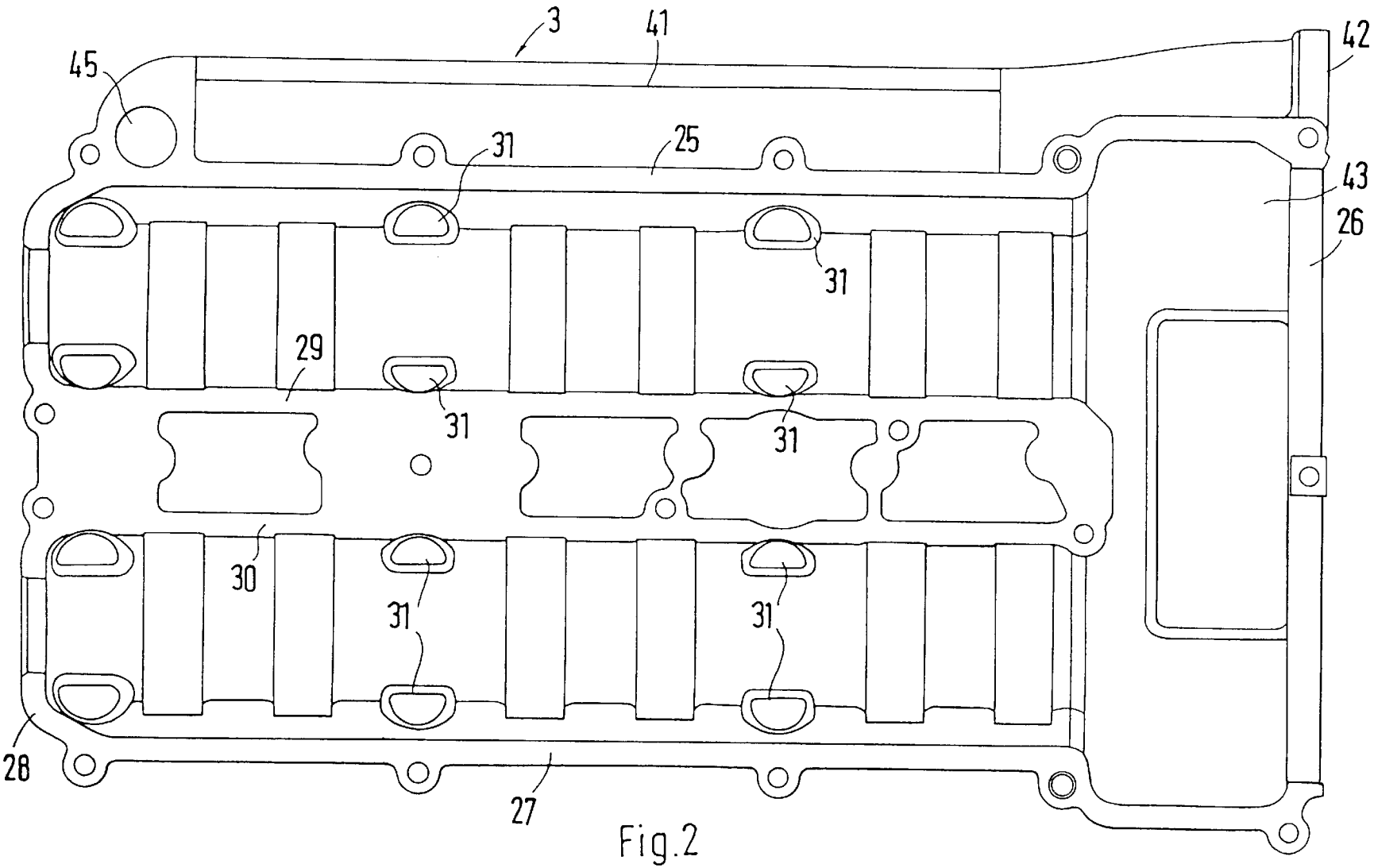
FIG. 2 is a top view of the flange surface of the cylinder head cover according to a preferred embodiment of the present invention.
Figure 3:
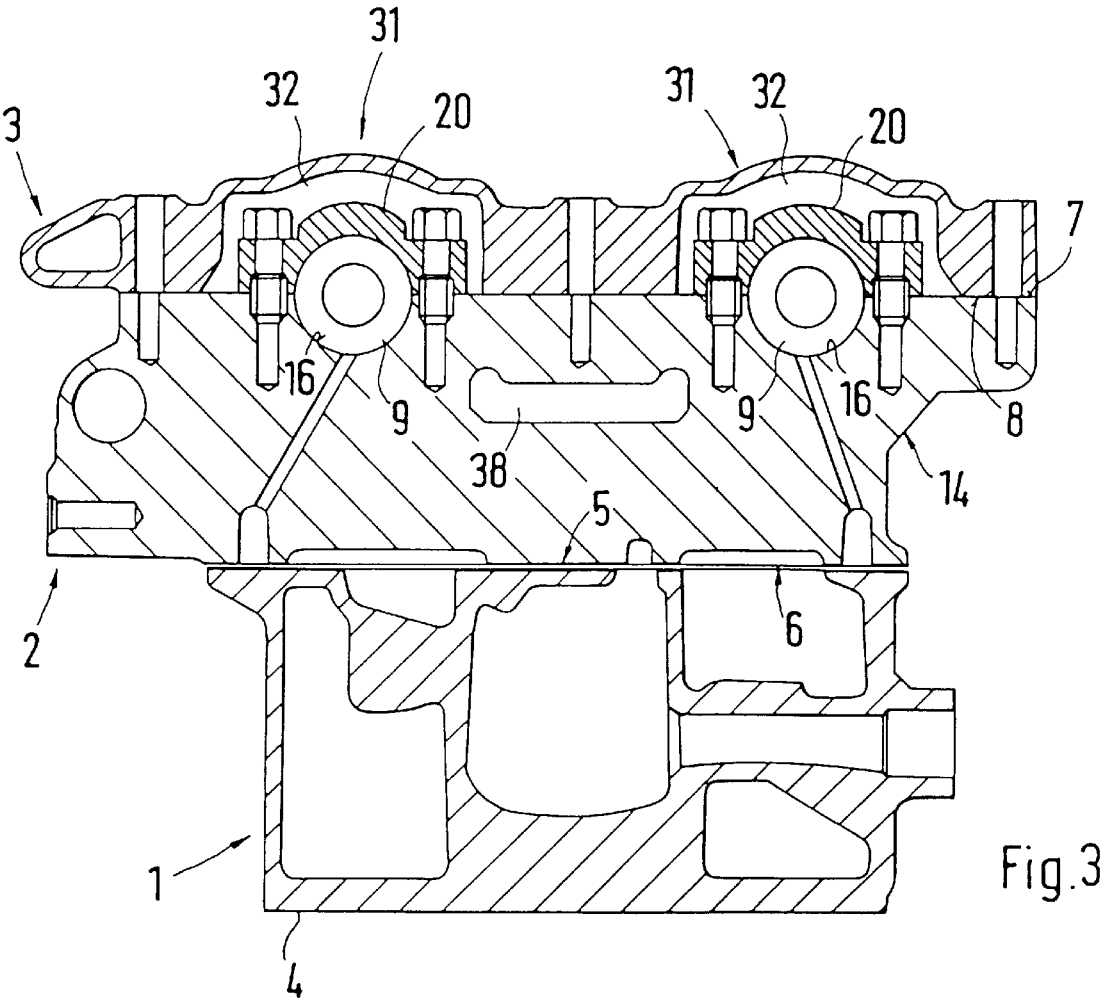
FIG. 3 is a cross-sectional view of the cylinder head along Line III—III according to FIG. 1.
Figure 4:
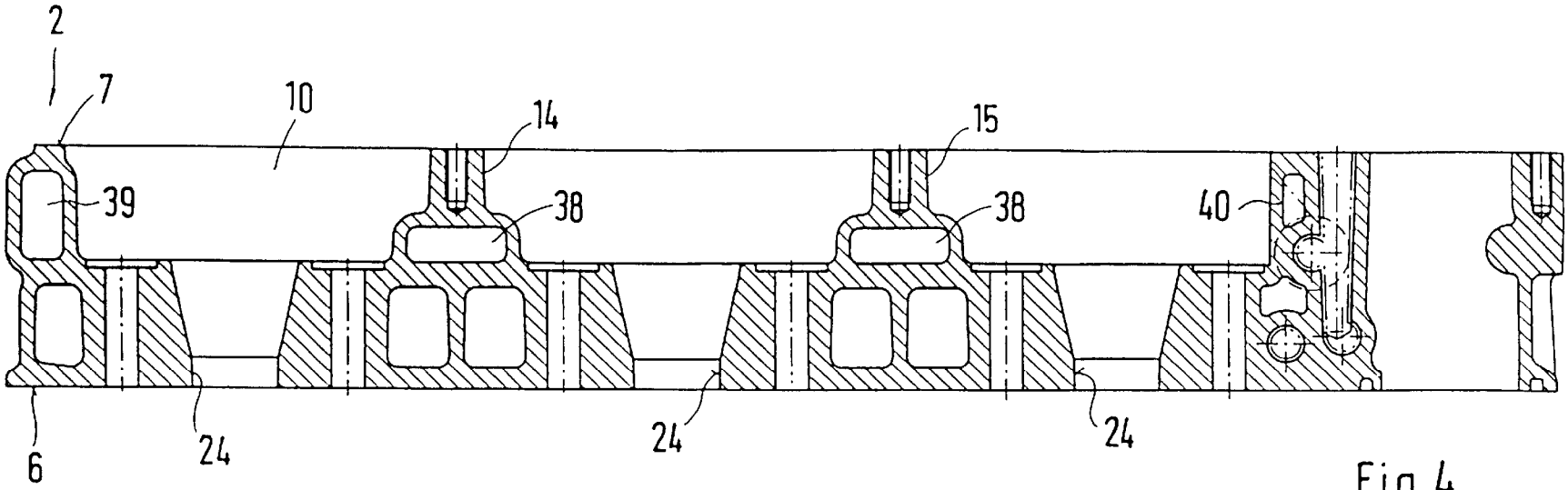
FIG. 4 is a longitudinal sectional view of the camshaft housing along Line IV—IV according to FIG. 1.

Without being limited to this embodiment, the cylinder head illustrated in FIGS. 1 to 4 is shown as one of the two cylinder heads of a 6-cylinder horizontally opposed engine which is installed in the longitudinal direction of the vehicle. This cylinder is composed of three housing components, such as a cylinder head base housing 1, a camshaft housing 2 and a cylinder head cover 3. The cylinder head base housing 1 has a lower flange surface 4 which is used for the linking to the cylinder block or the crankcase which are not shown. When the cylinder head is mounted, the upper flange surface 5 of the cylinder head base housing 1 abuts the lower flange surface 6 of the camshaft housing 2. The upper flange surface 7 of the camshaft housing 2 abuts the flange surface 8 of the cylinder head cover 3. The camshaft housing 2 is used for accommodating bucket tappets, which are not shown, for operating the charge cycle valves and simultaneously contains the lower bearing cover for accommodating the two camshafts 9.

The camshaft housing 2 and the cylinder head cover 3 enclose an interior space in which the camshafts rotate and in which, during the operation of the internal-combustion engine, the lubricating oil accumulates which flows out of the bearing points of the camshafts and of the bucket tappets. This interior is divided by two longitudinal walls 10 and 11 which, together with the exterior walls 12 and 13, form three longitudinal sections. These three longitudinal sections are divided by two transverse walls 14 and 15 which each extend to the exterior walls 12, 13 and to the upper flange surface 7 of the camshaft housing 2. The respective lower halves of the bearing bores 16 are constructed in the two transverse walls. Four additional bearing sections 17 are constructed in the end walls 18 and 19. For the camshaft bearing, the respective upper bearing shells 20 are screwed onto the bearing sections 17 and the lower halves of the bearing bores in the transverse walls 14 and 15 (see FIG. 3).

The longitudinal walls 10 and 11 and the transverse walls 14 and 15, in connection with the exterior walls 12, 13, 18 and 19, bound three upper subspaces 21A to 21C, three center subspaces 22A to 22C and three lower subspaces 23A to 23C. The respective inlet-side bucket tappets and the assigned sections of the inlet camshaft are arranged in the upper subspaces 21A to 21C, and the outlet-side bucket tappets and the assigned portion of the outlet camshaft of one cylinder respectively are correspondingly arranged in the lower subspaces 23A to 23C. In the center subspaces 22A to 22C, bores 24 are arranged which lead into the combustion space and which are used for accommodating spark plugs or injection systems which are not shown.

The cylinder head cover 3 rests with its exterior walls 25 to 28 on the flange surface 7 of the camshaft housing 2. Furthermore, the cylinder head cover has two drawn-down longitudinal webs 29 and 30 which sealingly rest on the longitudinal walls 10 and 11. The cylinder head cover 3 is constructed such that it reaches at a narrow distance around the camshafts 9, the cam peripheries and the bearing areas of the camshaft. In the area of the transverse walls 14 and 15 respective lobes 31 are constructed in the cylinder head cover 3. Due to this adapted contour of the cylinder head cover, it is ensured that the space 32 between the camshaft bearings and the cylinder head cover are as small as possible. Furthermore, the lobes 31 ensure that the spaces 32 extend at an angle in the longitudinal direction of the cylinder head so that an oil passage is made difficult or is largely prevented.

An oil collecting duct 33 is integrated in the camshaft housing 2 in the area of the exterior wall 13 which is on the bottom in the installed position, which oil collecting duct 33 is connected with the subspaces 23A to 23C. In the area of the transverse walls 14 and 15, one opening 34, 35 respectively is constructed in the exterior wall 13, whose opening cross-section and position and course in the longitudinal direction of the cylinder head is in each case dimensioned such that they interact with the adjacent subspaces 23A, 23B and 23B, 23C. Subspace 23A is, in addition, connected with the collector 33 by way of an opening 36 arranged in the area of the exterior wall 18. Another opening 37 connects the collector 33 in the area of the exterior end wall 19 with the subspace 23C. As a result, each of the three subspaces 23A to 23C is connected with the collector by way of one forward and one rearward transition respectively.

In the area of the partitions 14 and 15, one cast-in duct 38 respectively is constructed which bridges the center subspaces 22A to 22C and connects the upper and lower subspaces with one another. In their cross-sectional shape and their position and course in the longitudinal direction of the cylinder head, these ducts 38 are constructed such that the duct 38 arranged in the area of the transverse wall 14 connects the upper subspaces 21A and 21B with the lower subspaces 23A and 23B. Correspondingly, the duct arranged in the area of the transverse wall 15, connects the upper subspaces 21B and 21C with the lower subspaces 23B and 23C. In the area of the end wall 18, a duct 39 connects the upper subspace 21A with the lower subspace 23A. Another duct 40 in the area of the exterior wall 19 connects the upper subspace 21C with the lower subspace 23C. Thus, the subspaces 21A to 21C are each connected by way of a forward and rearward duct with the lower subspaces 23A to 23C and by way of these with the collector 33.

Another collector 41 is integrated in the longitudinal wall of the cylinder head cover 3 which is on the bottom in the installed position. This collector 41 has a suction connection 42 which is arranged in the area of the end wall 26. In the embodiment described here, the timing case 43 is constructed in the area of this exterior wall and is used for accommodating and covering the timing drive which is not shown. In the area of the opposite end wall 28, a bore 45 is arranged which starts from the flange surface 8 and leads into the interior of the collector 41. This bore 45 communicates with an aligned bore 46 which, starting from the upper flange surface 7 of the camshaft housing 2, leads into the collector 33. This collector is also provided with a suction connection 47 which is arranged in the area of the timing case 43.

The two suction connections 42 and 47 are in each case connected with the suction side of an oil pump, which is not shown, is known per se and delivers the scavenged oil into the oil storage tank, which is also not shown, of the internal-combustion engine. The scavenging can take place, for example, by way of two separate oil pumps. However, it is also possible to carry out the oil scavenging by way of a pump with two separate suction connections.

In the operation of the internal-combustion engine, the oil emerging at the bearing points of the camshafts and bucket tappets accumulates in the subspaces 21A to 21C and 23A to 23C. Because of the effect of the force of gravity, the oil accumulating in the upper subspaces 21A to 21C arrives by way of the transverse ducts 38 to 40 in the lower subspaces 23A to 23C. The subspaces 23A to 23C, in turn, are connected by way of the openings 34 to 37 with the collector 33 which, also because of the effect of the force of gravity, is filled up with the oil accumulating in the subspaces. By way of the bores 45 and 46, the collector 41 is filled analogously.

If, during the operation of the internal-combustion engine, because of strong acceleration or deceleration operations, the main portion of the oil carried in the collectors accumulates in the area of the end wall 18, no oil or only a small fraction of the oil is scavenged by way of the collector 33 because, as the result of the corresponding oil level in the area of the transverse ducts 35, 37 facing the timing case 43, air can be taken in from the interior and a scavenging of the oil situated in the opposite area is not possible. However, this oil is scavenged by way of the collector 41, because this collector 41 is connected with the interior or the other collector only in the area of the front wall 18 and 28 so that its suction opening is constantly below the oil level.

If, in the case of oppositely directed acceleration or deceleration operations, the oil situated in the collectors accumulates essentially in the area of the timing case, under certain circumstances, air may be taken in through the opening 36, the bores 45 and 46 as well as the corresponding collector 41. Disposal of the oil from the cylinder head can nevertheless take place since oil is scavenged by way of the collector 33 via the transverse duct 37 arranged in the area of the timing case 43.

Due to this arrangement of the collector and the displaced arrangement of the connections into the interior or into the subspaces, it is ensured that, also in the case of strongly fluctuating oil levels in the interior of the cylinder head, always at least one of the two collectors with its corresponding transverse connection is connected with the interior such that the respective traverse connection is constantly situated below the oil level.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A cylinder head of a multi-cylinder internal-combustion engine having two overhead camshafts, comprising:

a cylinder head defining an interior space for receiving said camshafts, said cylinder head defining at least one oil collector which extends in a longitudinal direction of the cylinder head and which is connected with a suction connection of a pump, said interior space being divided into a plurality of subspaces by longitudinal walls located between the two camshafts and by at least one transverse wall, at least some of said subspaces being connected with an oil collector.

2. A cylinder head of an internal-combustion engine according to claim 1, wherein the at least one transverse wall forms a lower bearing shell which supports the camshaft.

3. A cylinder head of an internal-combustion engine according to claim 1, comprising two of said longitudinal walls arranged at a distance from each other between the two camshafts, said two longitudinal walls partitioning off an oil-free space for accommodating a spark plug or an injection system.

4. A cylinder head of an internal-combustion engine according to claim 1, further comprising upper transverse ducts communicating upper ones of the subspaces in which an upper one of the camshafts is disposed in an installed position with lower ones of the subspaces in which a lower one of the camshafts is disposed in an installed position.

5. A cylinder head of an internal-combustion engine according to claim 4, further comprising lower transverse ducts communicating said lower ones of the subspaces with said collector.

6. A cylinder head of an internal-combustion engine according to claim 5, wherein said lower transverse ducts are at least approximately aligned with said upper transverse ducts.

7. A cylinder head of an internal-combustion engine according to claim 4, wherein said upper transverse ducts are located in the area of the camshaft bearing.

8. A cylinder head of an internal-combustion engine, according to claim 1, wherein the cylinder head includes two separate collectors, each of said collectors extending in the longitudinal direction of the cylinder head, a second one of said collectors communicating with said interior space in only one of a forward area and a rearward area of the cylinder head, said first collector communicating with said interior space at least in the other of said forward area and said rearward area of the cylinder head.

9. A cylinder head of an internal-combustion engine according to claim 1, wherein said first collector further communicates with said interior space in a central area of the cylinder head.

10. A cylinder head of an internal-combustion engine according to claim 1, wherein the cylinder head comprises a plurality of components, and wherein said collectors are defined in different ones of said plurality of components.

11. A cylinder head of an internal-combustion engine according to claim 1, wherein said second collector is constructed in a cylinder head cover of said cylinder head.

12. A cylinder head of an internal-combustion engine according to claim 1, wherein said first collector is constructed in a camshaft housing of said cylinder head.

13. A cylinder head, comprising a camshaft housing including:

a pair of longitudinal exterior walls;

a pair of end exterior walls extending between respective ends of said longitudinal exterior walls, said longitudinal exterior walls and said end exterior walls defining an interior space;

at least one transverse wall extending between said longitudinal exterior walls through said interior space and defining first and second bearings for supporting first and second camshafts, respectively;

at least one longitudinal wall extending between said end exterior walls through said interior space at a location between said first and second bearings of said at least one transverse wall, said at least one transverse wall and said at least one longitudinal wall dividing said interior space into a plurality of subspaces; and a longitudinally-extending oil collecting duct.

14. A cylinder head of an internal-combustion engine according to claim 13, comprising two of said at least one longitudinal walls arranged at a distance from each other, said two longitudinal walls partitioning off an oil-free space for accommodating a spark plug or an injection system.

15. A cylinder head of an internal-combustion engine according to claim 13, further comprising upper transverse ducts communicating upper ones of the subspaces in which an upper one of the camshafts is disposed in an installed position with lower ones of the subspaces in which a lower one of the camshafts is disposed in an installed position.

16. A cylinder head of an internal-combustion engine according to claim 15, further comprising lower transverse ducts communicating said lower ones of the subspaces with said collector.

17. A cylinder head of an internal-combustion engine according to claim 16, wherein said lower transverse ducts are at least approximately aligned with said upper transverse ducts.

18. A cylinder head of an internal-combustion engine according to claim 15, wherein said upper transverse ducts are located between said first and second bearings.

19. A cylinder head of an internal-combustion engine according to claim 13, further comprising a cylinder head cover defining a longitudinally-extending oil collecting duct.

20. A cylinder head of an internal-combustion engine according to claim 19, wherein said longitudinally-extending oil collecting duct of said cylinder head cover communicates with said interior space in only one of a forward area and a rearward area of the cylinder head, and said longitudinally-extending oil collecting duct of said camshaft housing communicates with said interior space at least in the other of said forward area and said rearward area of the cylinder head.

* * * * *